US008381545B2

(12) United States Patent
Rydlewicz

(10) Patent No.: US 8,381,545 B2
(45) Date of Patent: Feb. 26, 2013

(54) TRIANGULAR STAR SHAPED DIAMOND HAVING HEARTS AND ARROWS PATTERN

(75) Inventor: Roni Rydlewicz, Brussels (BE)

(73) Assignee: Worldwide Diamond Trademarks Ltd. (CA)

( * ) Notice: Subject to any disclaimer, the term of this patent is extended or adjusted under 35 U.S.C. 154(b) by 1088 days.

(21) Appl. No.: 11/744,588

(22) Filed: May 4, 2007

(65) Prior Publication Data

US 2008/0271487 A1 Nov. 6, 2008

(51) Int. Cl.
*A44C 17/00* (2006.01)

(52) U.S. Cl. ..... 63/32; D11/89; D11/90

(58) Field of Classification Search ..... 63/32; D11/89, D11/90

See application file for complete search history.

(56) References Cited

U.S. PATENT DOCUMENTS

| | | | | | |
|---|---|---|---|---|---|
| D283,878 | S | * | 5/1986 | Henrickson | D11/90 |
| D411,133 | S | * | 6/1999 | Alvarado | D11/90 |
| 6,698,239 | B2 | * | 3/2004 | Wueste | 63/32 |
| D501,156 | S | * | 1/2005 | Tolkowsky | D11/90 |
| D502,886 | S | * | 3/2005 | Vroomen | D11/90 |
| D511,989 | S | * | 11/2005 | Pereira De Castro et al. | D11/90 |
| D521,409 | S | * | 5/2006 | De Castro et al. | D11/90 |
| D567,140 | S | * | 4/2008 | Rydlewicz | D11/90 |
| D610,936 | S | * | 3/2010 | Swarovski | D11/89 |
| 7,971,452 | B2 | * | 7/2011 | Rydlewicz | 63/32 |
| 7,992,410 | B2 | * | 8/2011 | Rydlewicz | 63/32 |
| 2007/0006616 | A1 | * | 1/2007 | Riemer | 63/32 |
| 2008/0271485 | A1 | * | 11/2008 | Rydlewicz | 63/32 |
| 2008/0271486 | A1 | * | 11/2008 | Rydlewicz | 63/32 |

* cited by examiner

*Primary Examiner* — Jack W. Lavinder
*Assistant Examiner* — Emily Morgan
(74) *Attorney, Agent, or Firm* — Baker & Hostetler LLP

(57) ABSTRACT

A triangular star shaped diamond adapted to display a hearts and arrows pattern when exposed to light comparable to the hearts and arrows pattern in a round diamond, comprising: six main crown facets, twelve crown half facets, a table facet, six main pavilion facets and an even number of main girdle facets separating the crown facets from the pavilion facets with each main crown facet having a symmetrical main crown facet in an opposing relationship and at least one edge in parallel alignment with an edge of the opposing main crown facet.

15 Claims, 5 Drawing Sheets

TRIANGULAR STAR SHAPED DIAMOND HAVING HEARTS AND ARROWS PATTERN

FIELD OF THE INVENTION

The present invention relates to the field of cut diamonds and more particularly to a triangular star shaped diamond adapted to generate a hearts and arrows pattern comparable and substantially equivalent to the hearts and arrows pattern generated by an ideal round cut diamond when exposed to light.

BACKGROUND OF THE INVENTION

A hearts and arrows pattern was successfully developed for a round shaped diamond possessing a nearly perfect round shape and having symmetrical and equal cut facets polished to satisfy the following requirements for its cut facets, angle parameters and alignment relationships:

The shape of the diamond must be perfectly symmetrical
8 main crown and 24 subsidiary crown facets
8 main bottom and 16 subsidiary bottom facets
All main facets (crown & bottom) have to be polished at a perfect 45° angle to each other
All facets are perfectly aligned
All the bottom main facets are of equal size and at an angle ranging from 40.6°-41.0°
All the bottom subsidiary facets are of equal size and at an angle which is exactly 1.2° steeper than the main facets (main bottom angle 40.6°-41.0°+subsidiary 41.8°-42.2°)
All the main crown facets are of equal size and at an angle ranging from 33.8°-35.1°. They have to be perfectly aligned on the main bottom facets.
All the subsidiary crown facets are of equal size and perfectly aligned on the main crown and subsidiary bottom facets and polished at an equal angle.
The ideal proportions for the round cut diamond are:
total depth 59.4%-62.4%
crown height 14.5%-16.0%
girdle thickness 1.5%-2.95%
Roundness 99.0%-100%
Table size: 53.0%-57.5%

Although diamonds are typically cut into many geometrical shapes other than round such as, for example, a heart shape, oval, pear, marquis, princess, emerald, etc., only the round cut diamond has a nearly perfect symmetrical shape and can be polished to provide perfectly equal and symmetrical facets. Accordingly, in the diamond industry, it is widely believed that it is impossible to obtain a true hearts and arrows pattern in a non-symmetrically shaped diamond. Interestingly, what is common to all of the above shaped diamonds, other than the round shape, is its asymmetry. Moreover, if one follows the traditional method used in the diamond industry, of positioning the facets in line with the shape of the diamond, a true hearts and arrows pattern will indeed not be realizable.

A new diamond shape was discovered in accordance with the subject invention that can be cut from a rough diamond having a relatively triangular shape into a diamond having a novel triangular star shape which will yield a true hearts and arrows pattern when exposed to light. A traditional triangular shaped diamond is cut to form facets in line with the shape of the diamond and does not yield a hearts and arrows pattern. The traditional triangle cut has the following facets:

15 girdle facets
3 main crown facets
9 crown star facets 12 crown half facets
1 table facet
3 main pavilion facets
12 pavilion half facets
Total number of facets: 55

SUMMARY OF THE INVENTION

The triangular star shaped diamond of the present invention possesses a heretofore unknown faceting pattern which yields a hearts an arrows pattern substantially equivalent to the hearts and arrows pattern in a round diamond. It is essential to the faceting pattern in the triangular star shaped diamond of the present invention that each main crown facet have a symmetrical facet in an opposing relationship and at least one edge in parallel alignment with an edge of the opposing main crown facet. It is also desirable in giving the diamond a star shape that it contain an equal number of girdle facets polished to align the girdle facets at a predetermined angle to ensure the girdle facets are of substantially equal length and outline a triangular shape. The triangular star shaped diamond of the present invention comprises: six main crown facets twelve crown half facets, a table facet, six main pavilion facets and an equal number main girdle facets, preferably six, separating the crown facets from the pavilion facets with each main crown facet having a symmetrical main crown facet in an opposing relationship and at least one edge in parallel alignment with an edge of the opposing main crown facet. Moreover, in the triangular star shaped diamond of the present invention the main pavilion facets are aligned to the main crown facets and not to the shape of the diamond. In addition, the triangular shaped diamond of the present invention should also preferably include twelve pavilion half facets and six crown star facets. The total number of facets in the triangular star shaped diamond of the present invention should preferably be 49.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figure 1A:
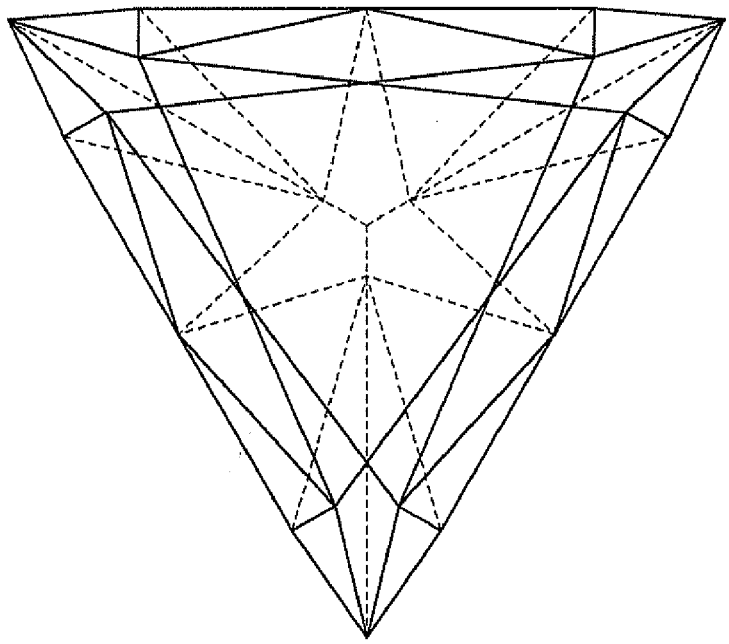
FIG. 1A (Prior Art)
FIG. 1A is a table view of a traditional triangle cut diamond.
Figure 1B:
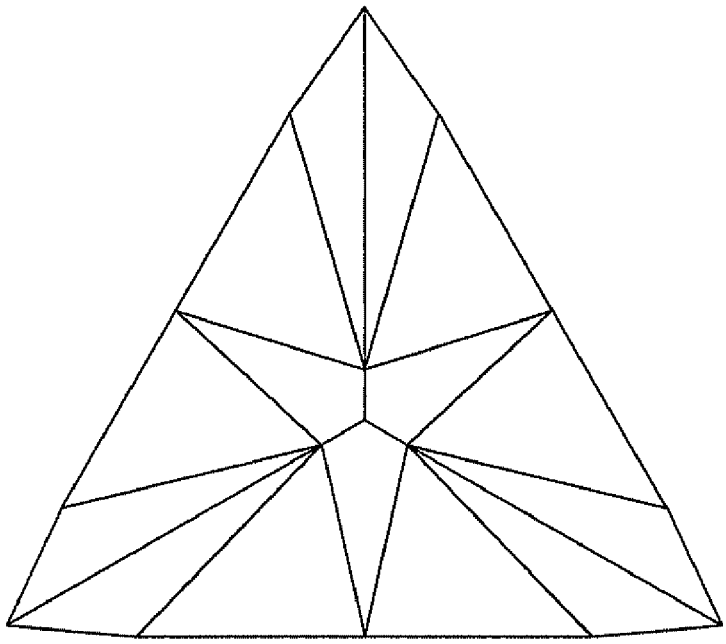
FIG. 1B (Prior Art)
FIG. 1B is an upside down table view of the traditional triangle cut diamond of FIG. 1A.

A diamond is a crystal which functions as a prism for dispersing light by means of reflection and refraction. A traditional cut triangular diamond is shown in FIGS. 1A-1B and possesses three main crown facets and three main pavilion facets with the facets positioned in line with the shape of the diamond. In sharp contrast, the triangular shaped diamond 10 of the present invention is cut, as is shown in FIGS. 2-8 and more specifically as shown in FIG. 3, to form six main crown facets identified by the capital letters: A, B, C, D, E and F with each of the six main crown facets having a substantially equal and oppositely positioned main crown facet surrounding a single Table facet T and having at least one edge in parallel alignment with a corresponding edge of the oppositely positioned main crown facet. For example, facet A lies opposite facet D with each of the facets A and D having edges 12 and 15 aligned in parallel. Moreover, in contrast with tradition, the main crown facets A-F are not polished in line with the shape of the diamond 10.

Figure 2:
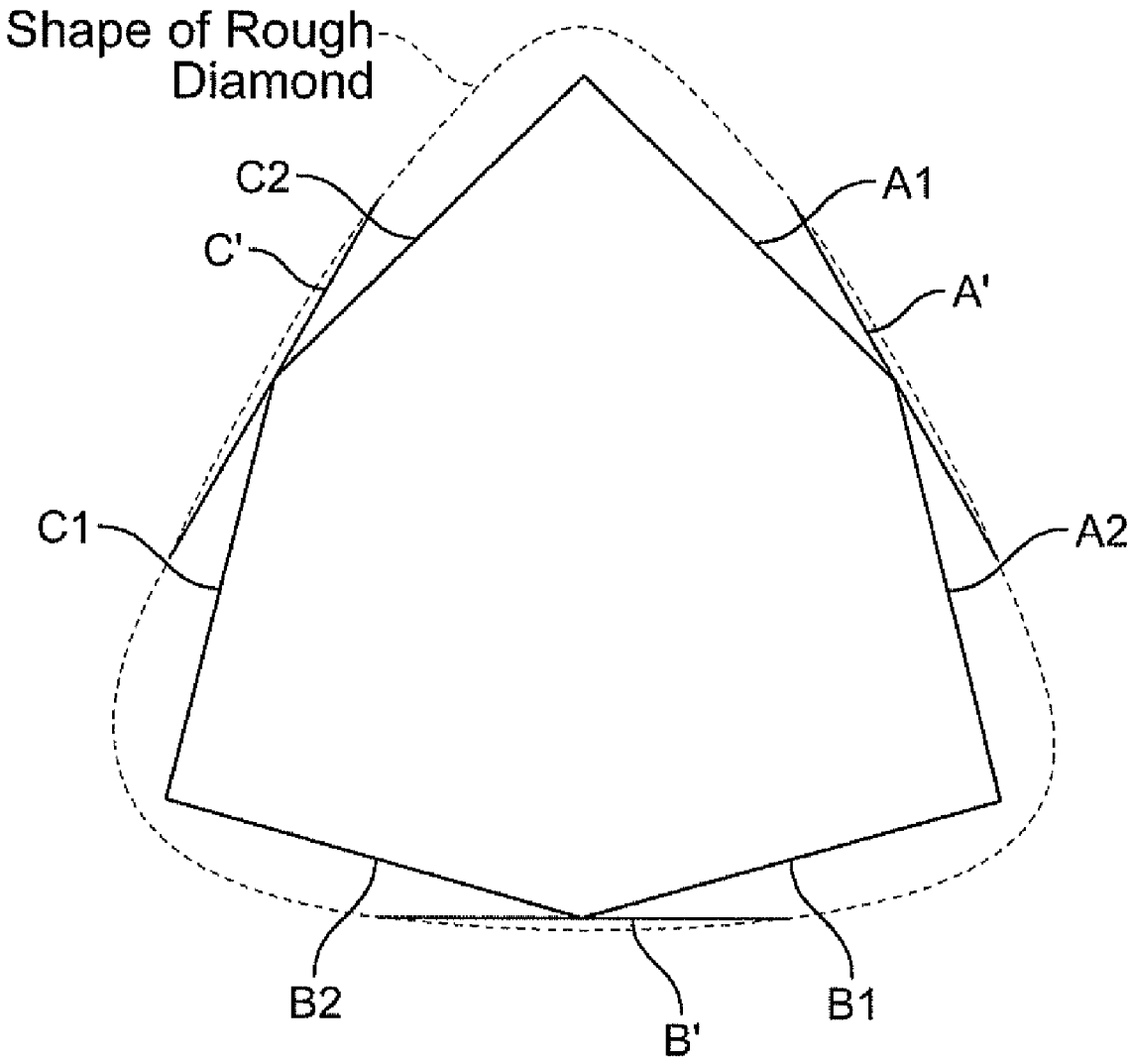
FIG. 2 is a top view of the triangular star shaped diamond of the present invention showing in dotted lines the shape of the rough diamond before it is cut into a triangular star shaped diamond and showing the initial girdle facet lines before being polished.
Figure 3:
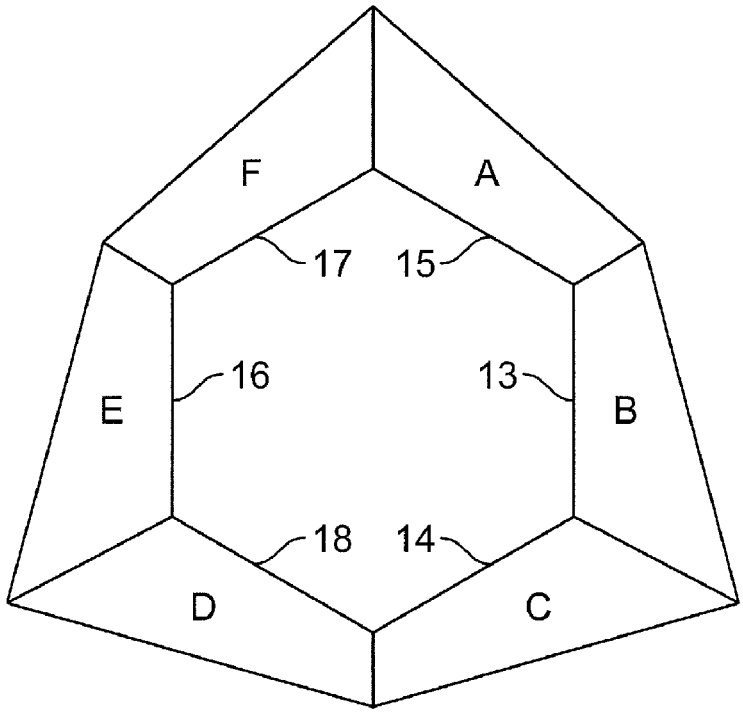
FIG. 3 is another top view of the triangular star shaped diamond of the present invention showing how the main crown facets are polished in accordance with the subject invention.

As shown in FIG. 2, the triangular shaped diamond 10 of the present invention has six girdle facets A1, A2, B1, B2, and C1, C2 respectively. The shape of the diamond 10 is initially formed from a rough diamond having a generally triangular shaped geometry as shown in FIG. 2 using dotted lines to illustrate the rough shape of the diamond. The diamond 10 is initially polished to form three initial girdle facets A', B' and C' which are symmetrically disposed about the body of the rough diamond 10. The initial girdle facets A', B' and C' are cut at preferably 60° from each other. The initial girdle facet A', B' and C' are then polished to divide each initial girdle facet into two girdle facets at preferably 20° on each side (left and right) from the center of each initial girdle facet such that two girdle facets A1, A2 are formed from the initial girdle facet A'; two girdle facets B1, B2 are formed from the initial girdle facet B' and two girdle facets C1, C2 are formed from the initial girdle facet C'. This forms six girdle facets A1, A2, B1, B2 and C1, C2 from the initial three girdle facets A', B' and C' with each of the girdle facets A1, A2, B1, B2 and C1, C2 being essentially of equal length and give the diamond 10 the triangular shape upon which the crown facets are polished as shown in FIG. 3.

The main crown facets A-F are polished onto the diamond 10 such that each of the six main crown facets will have a substantially equal and oppositely positioned main crown facet. However, the main crown facets are not in alignment with the main girdle facets and are in fact shifted from a corresponding main girdle facet by polishing each main crown facet at a predetermined angle away from the adjacent corresponding girdle facet. Each of the three main crown facets A, C and E should preferably be directed 15° away from its adjacent corresponding main girdle facet in a first common direction and the main crown facets B, D and F should be directed the same 15° away from its adjacent corresponding main girdle facet but in a common second direction opposite the first direction such that each main crown facet has an edge in parallel alignment with an edge of an opposing main crown facet, i.e., opposing edges 12 and 15 of main crown facets A and D should be in parallel alignment, opposing edges 13 and 16 of main crown facets B and E should be in parallel alignment and opposing edges 14 and 17 of main crown facets C and F should be in parallel alignment respectively. The main crown facets A-F are preferably polished within an angle degree range of 33.8°-35.2° and are polished to be substantially of equal size and depth.

Figure 4:
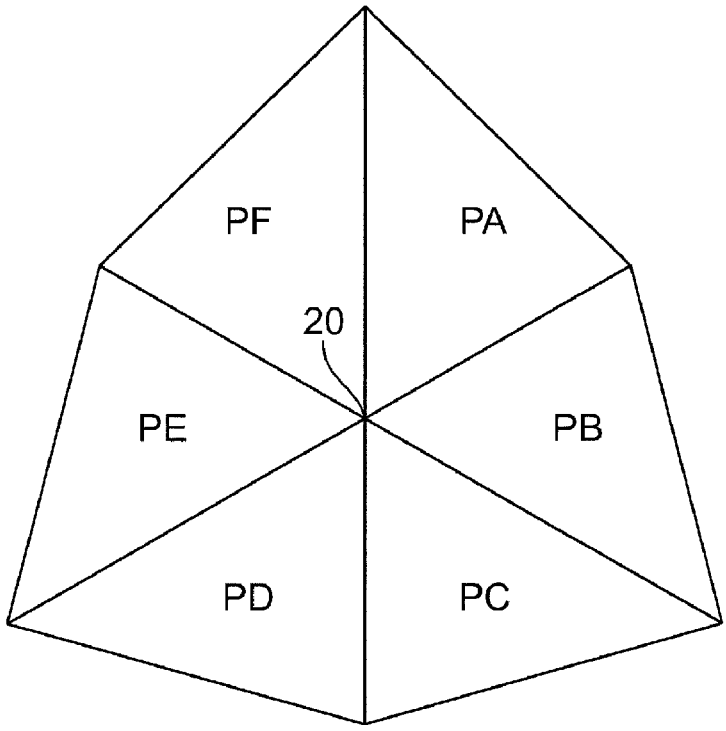
FIG. 4 is a pavilion or bottom view of the triangular star shaped diamond of the present invention showing the six main pavilion facets.
Figure 5:
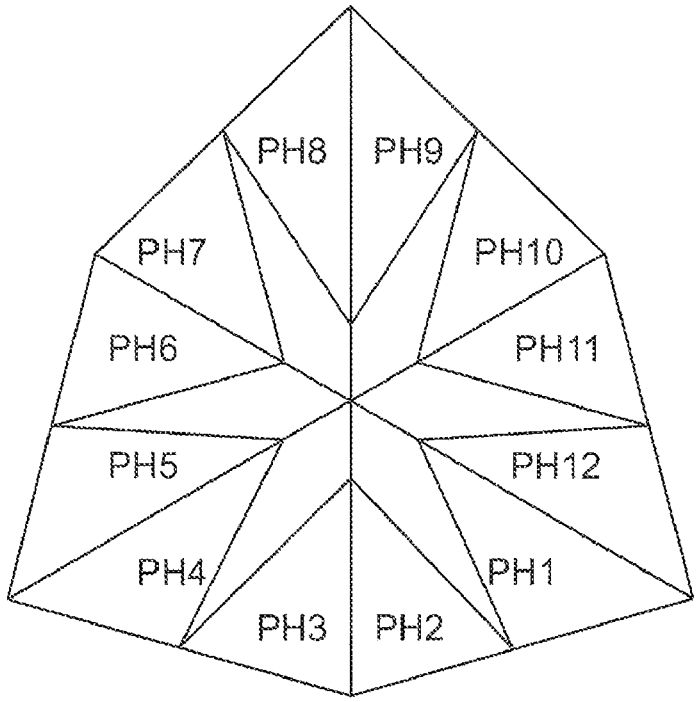
FIG. 5 is a pavilion or bottom view of the triangular star shaped diamond of the present invention showing the arrangement of the twelve pavilion half facets and the six main pavilion facets relative to the center or cutlet of the diamond with the main pavilion facets providing a star shape.

The pavilion side of the diamond is then polished to provide six main pavilion facets PA, PB, PC, PD, PE and PF, as is shown in FIGS. 4 and 5, with each pavilion facet polished at an angle degree ranging from 40.6°-41.1° in alignment corresponding to the six main crown facets A-F and not to the shape of the diamond. The six pavilion facets PA-PF are triangular in shape, meet at the common culet point 20 which is at the center of the diamond 10 and form a star-like pattern. Two pavilion half facets are polished about each main pavilion facet to form a total of 12 pavilion half facets PH1, PH2, PH3, PH4, PH5, PH6, PH7, PH8, PH9, PH10, PH11 and PH12. All of the pavilion half facets are polished within an angle degree range of 42.4°-43.4° and should be substantially of the same height as measured from the culet point 20 but will be of varying depth levels as is evident in FIG. 5 wherein facet PH1 has a significantly higher depth level than facet PH2, facet PH4 has a significantly higher depth level than PH3 and PH5 has a significantly higher depth level than PH6 etc. Nevertheless each of the pavilion facets are substantially identical in height and angle degrees.

Figure 6:
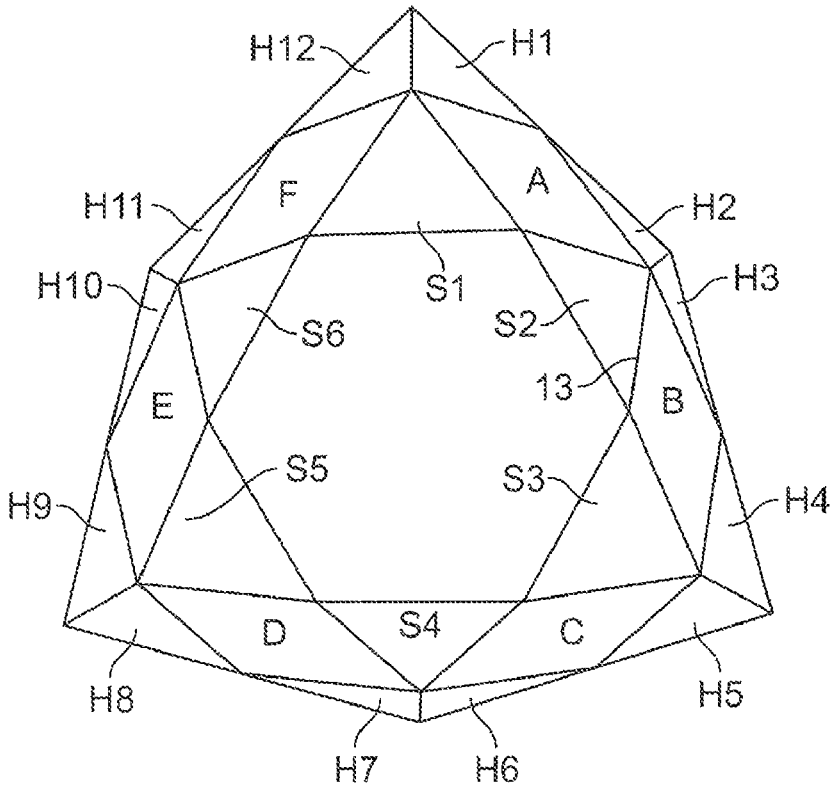
FIG. 6 is another top view of the triangular star shaped diamond of the present invention showing the main crown facets, crown half facets and crown star facets in an arrangement surrounding the table facet, with the outer lines of the crown half facets H1-H12 shown in dotted lines to make it clear from FIG. 6 that the shape of the dotted lines correspond to the shape in FIG. 3.
Figure 7:
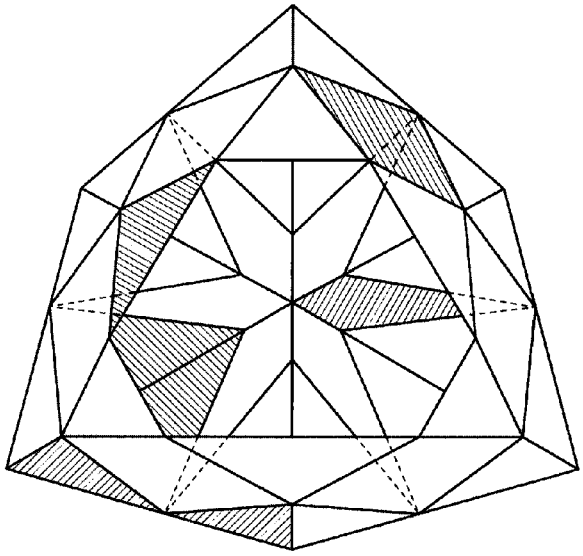
FIG. 7 is yet another top view of the triangular star shaped diamond of the present invention showing the main crown facets and crown star facets in an arrangement showing the main pavilion facets and pavilion half facets projecting through the table facet and displaying a star pattern.
Figure 8:
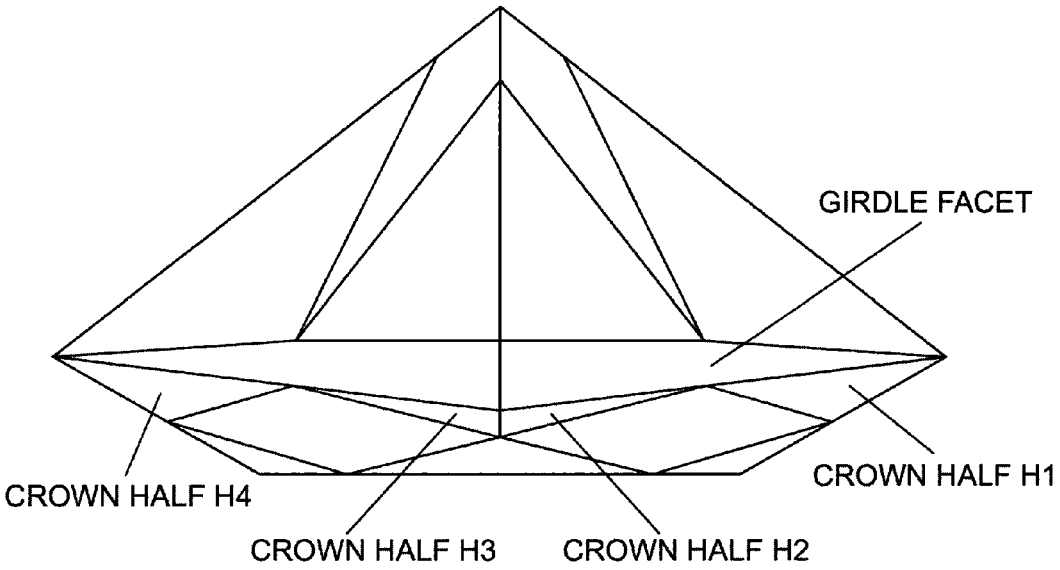
FIG. 8 is a side profile view of the triangular star shaped diamond of the present invention.

The crown star and crown half facets are preferably polished after the pavilion side of the diamond has been polished to form six crown star facets S1, S2, S3, S4, S5 and S6 as is shown in FIGS. 6 and 7 surrounding the table facet T and within an angle degree range of 13.8°-16.8° but in an arrangement such that three of the crown star facets S1, S3 and S5 have a substantially common shape which is different from the substantially common shape of the crown star facets S2, S4 and S6. This is due to the non-alignment of the main crown facets and the main girdle facets as explained earlier. Lastly, the crown half facets H1, H2, H3, H4, H5, H6, H7, H8, H9, H10, H11 and H12 are polished within an angle degree range of 35.4°-40.6°. However, because of the anomalies in the alignment of the main crown facets and the girdle facets it is preferred to polish the crown half facets H1, H4, H5, H8, H9 and H12 within an angle degree that is at least 2° higher than the crown half facets H2, H3, H6, H7, H10 and H11.

The triangular shaped diamond of the present invention will yield a hearts and arrows pattern substantially equivalent to the hearts and arrows pattern of the round cut despite its asymmetrical shape provided it is shaped and cut in accordance with the present invention as hereinabove taught and preferably when cut to satisfy the optimum parameters set forth below in Table I:

TABLE I

| | |
|---|---|
| Total Depth: | 59.4%-67.8% |
| Table size | 52.4%-58.2% |
| Pavilion Depth | 46.2%-49.8% |
| Crown Height | 13.6%-16.8% |
| Main crown angle | 33.8°-35.2° |
| Main pavilion angle | 40.6°-41.1° |
| Crown star facet angle | 13.8°-17.4° |
| Crown halves facet angle | 34.6°-43.4° |
| Pavilion halves facet angle | 42.4%-43.4 |

The diamond should be measured repeatedly as to insure the cut parameters are obtained. The angles and dept size should be verified for accuracy using conventional analyzers.

What is claimed is:

1. A triangular star shaped diamond adapted to display a hearts and arrows pattern when exposed to light comparable to the hearts and arrows pattern in a round diamond, comprising: six main crown facets, twelve crown half facets, a table facet, six main pavilion facets, an even number of crown star facets surrounding the table facet and an even number of main girdle facets essentially equal in length separating the main crown facets from the pavilion facets, with each of the girdle facets forming a triangular shape and with each main crown facet arranged opposite to another main crown facet about the table facet such that an edge of each oppositely positioned main crown facet lies in parallel alignment with respect to the other and wherein the main crown facets are arranged adjacent to the main girdle facets such that the main crown facets are not in alignment with the main girdle facets.

2. A triangular star shaped diamond as defined in claim 1 further comprising six main girdle facets.

3. A triangular star shaped diamond as defined in claim 2 wherein each main crown facet is shifted from a corresponding main girdle facet by a predetermined angular degree and with the six main pavilion facets disposed at an angle to said six main crown facets.

4. A triangular star shaped diamond as defined in claim 3 wherein said predetermined angle is 15° with three of the main crown facets directed away from its adjacent corresponding main girdle facet in a common first direction and the other three main crown facets directed away from its adjacent corresponding main girdle facet in a common second direction opposite the first direction.

5. A triangular star shaped diamond as defined in claim 1 wherein each of the six main crown facets are polished within an angle degree range of 33.8°-35.2° and are substantially equal in size and depth.

6. A triangular star shaped diamond as defined in claim 5 wherein said six main pavilion facets are polished at an angle degree ranging from 40.6°-41.1° in alignment corresponding to the six main crown facets.

7. A triangular star shaped diamond as defined in claim 6 wherein each of the six pavilion facets are triangular in shape, meet at the common culet point of the diamond and form a star-like pattern.

8. A triangular star shaped diamond as defined in claim 7 wherein each of the six main pavilion facets are polished at 60° from each adjacent main pavilion facet.

9. A triangular star shaped diamond as defined in claim 7 further comprising twelve pavilion half facets.

10. A triangular star shaped diamond as defined in claim 9 wherein the twelve pavilion half facets are each polished within an angle degree range of 42.4°-43.4° and should be substantially of the same height as measured from the culet point but will be of varying depth levels relative to one another.

11. A triangular star shaped diamond as defined in claim 9 wherein a set of two pavilion half facets will lie adjacent each main pavilion facet.

12. A triangular star shaped diamond as defined in claim 1 further comprising six crown star facets surrounding the table facet.

13. A triangular star shaped diamond as defined in claim 12 wherein the six crown star facets are each polished within an angle degree range of 13.8°-16.8° but in an arrangement such that three of the crown star facets have a substantially common shape different from the substantially common shape of the other three crown star facets.

14. A triangular star shaped diamond as defined in claim 13 further comprising twelve crown half facets polished within an angle degree range of 35.4°-40.6°.

15. A triangular star shaped diamond as defined in claim 14 wherein six of the crown half facets are polished within an angle degree that is at least 2° higher than the other six crown half facets.

* * * * *